US009404384B2

(12) United States Patent
Do

(10) Patent No.: US 9,404,384 B2
(45) Date of Patent: Aug. 2, 2016

(54) GAS TURBINE ENGINE SYNCHRONIZING RING WITH MULTI-AXIS JOINT

(75) Inventor: Logan H. Do, Canton, CT (US)

(73) Assignee: United Technologies Corporation, Hartford, CT (US)

( * ) Notice: Subject to any disclaimer, the term of this patent is extended or adjusted under 35 U.S.C. 154(b) by 1088 days.

(21) Appl. No.: 13/611,748

(22) Filed: Sep. 12, 2012

(65) Prior Publication Data

US 2014/0072413 A1 Mar. 13, 2014

(51) Int. Cl.
*F01D 17/16* (2006.01)

(52) U.S. Cl.
CPC ..... *F01D 17/162* (2013.01); *F05D 2260/50* (2013.01)

(58) Field of Classification Search
CPC ..... F01D 17/16; F01D 17/162; F01D 17/165; F01D 17/167; F05D 2260/50
See application file for complete search history.

(56) References Cited

U.S. PATENT DOCUMENTS

| | | | | |
|---|---|---|---|---|
| 4,773,821 | A * | 9/1988 | Gonthier et al. | 415/150 |
| 4,826,399 | A | 5/1989 | Perez | |
| 6,398,483 | B1 * | 6/2002 | Conete et al. | 415/9 |
| 6,984,104 | B2 | 1/2006 | Alexander et al. | |
| 7,278,819 | B2 | 10/2007 | Schilling | |
| 7,448,848 | B2 | 11/2008 | Alexander et al. | |
| 7,458,764 | B2 | 12/2008 | Lombard et al. | |
| 8,092,157 | B2 * | 1/2012 | McCaffrey | 415/160 |
| 8,226,357 | B2 * | 7/2012 | Bouru et al. | 415/150 |
| 8,360,760 | B2 | 1/2013 | Pekrul | |
| 2007/0003411 | A1 | 1/2007 | Manzoori | |
| 2007/0048126 | A1 | 3/2007 | Schilling | |
| 2009/0088800 | A1 | 4/2009 | Blain et al. | |
| 2009/0116954 | A1 * | 5/2009 | Bouru et al. | 415/125 |
| 2010/0124489 | A1 | 5/2010 | Suzuki et al. | |
| 2010/0166540 | A1 | 7/2010 | Perez et al. | |
| 2010/0189549 | A1 | 7/2010 | Gilman et al. | |
| 2011/0023444 | A1 | 2/2011 | Veilleux, Jr. | |
| 2011/0142702 | A1 | 6/2011 | Pekrul | |
| 2011/0158837 | A1 | 6/2011 | Pekrul | |
| 2011/0165007 | A1 | 7/2011 | Pekrul | |
| 2011/0168127 | A1 | 7/2011 | Pekrul | |
| 2011/0171051 | A1 | 7/2011 | Pekrul | |
| 2011/0176947 | A1 | 7/2011 | Pekrul | |
| 2011/0200473 | A1 | 8/2011 | Pekrul | |
| 2012/0076641 | A1 | 3/2012 | Jarrett, Jr. et al. | |
| 2014/0072413 | A1 * | 3/2014 | Do | 415/157 |

FOREIGN PATENT DOCUMENTS

| | | | |
|---|---|---|---|
| EP | 2211026 | A2 | 7/2010 |
| GB | 2400416 | A | 10/2004 |
| WO | W02012/013909 | A1 | 2/2012 |

OTHER PUBLICATIONS

International Search Report and Written Opinion from PCT Application Serial No. PCT/US2013/058922, dated Dec. 16, 2013, 14 pages.
Extended European Search Report from EP Application Serial No. 13836709.9, Dated Oct. 21, 2015, 6 pages.

* cited by examiner

*Primary Examiner* — Ninh H Nguyen
*Assistant Examiner* — Christopher R Legendre
(74) *Attorney, Agent, or Firm* — Kinney & Lange, P.A.

(57) ABSTRACT

An assembly includes a synchronizing ring, a vane arm, and a multi-axis joint. The multi-axis joint connects the synchronizing ring to the vane arm and provides the vane arm with movement about a first pivot axis and a second pivot axis.

17 Claims, 6 Drawing Sheets

GAS TURBINE ENGINE SYNCHRONIZING RING WITH MULTI-AXIS JOINT

BACKGROUND

The present invention is related to gas turbine engines, and in particular to a system for positioning variable vanes of gas turbine engines.

Gas turbine engines rely on rotating and stationary components to effectively and efficiently control the flow of air through the engine. Rotating components include rotor blades employed in compressor and turbine sections for compressing air and extracting energy from air after combustion. Stationary components include vanes placed in the airflow to aid in directing the airflow. By varying the orientation of the vanes (i.e., pivoting them to vary the profile provided to the airflow), airflow characteristics can be optimized for various operating conditions.

One system for providing actuation of the vanes is an actuator connected to the plurality of variable vanes via a series of linkages including synchronizing rings and vane arms. Current vane arm and synchronizing ring designs create a bending and twisting moment on the vane arm when the synchronizing ring rotates to vary the orientation of the vanes. This loading condition is caused by over constraint between a vane arm pin and a bushing in which the pin is disposed. This over constrained loading condition occurs on multiple vanes in multiple stages, and creates a large reaction load against movement of the synchronizing ring. Thus, the actuator is required to work harder to overcome the reaction load. Additionally, the loading condition also contributes to inaccuracy with regard to the orienting of the variable vanes, which has a negative impact on engine performance.

SUMMARY

An assembly includes a synchronizing ring, a vane arm, and a multi-axis joint. The multi-axis joint connects the synchronizing ring to the vane arm and provides the vane arm with movement about a first pivot axis and a second pivot axis.

A kit includes a synchronizing ring, a vane arm and a multi-axis joint. The multi-axis joint adapted to be disposed in and extend from the synchronizing ring to connect the vane arm to the synchronizing ring.

A gas turbine engine includes an engine case, a compressor and/or turbine section, a synchronizing ring, a plurality of vane arms and a plurality of multi-axis joints. The compressor and/or turbine section has at least a first stage of variable vanes circumferentially spaced radially inward of the engine case. The synchronizing ring is disposed about the engine case. The vane arms are connected to the variable vanes. The plurality of multi-axis joints connect the synchronizing ring to the vane arms and each multi-axis joint provides each vane arm with movement about a first pivot axis and a second pivot axis.

DETAILED DESCRIPTION

The present application discloses a joint feature that allows a vane arm to be actuated by synchronizing ring with reduced bending/twisting moment on the vane arm. In particular, the joint feature introduces an additional degree of freedom into the system by allowing the vane arm to pivot about a second rotational axis relative to the synchronizing ring. As a result of introducing the joint feature, the size and weight of an actuator required to move the synchronizing ring can be reduced. Additionally, introducing the first trunnion improves positioning accuracy of the variable vanes, which has a positive impact to engine performance.

Figure 1:
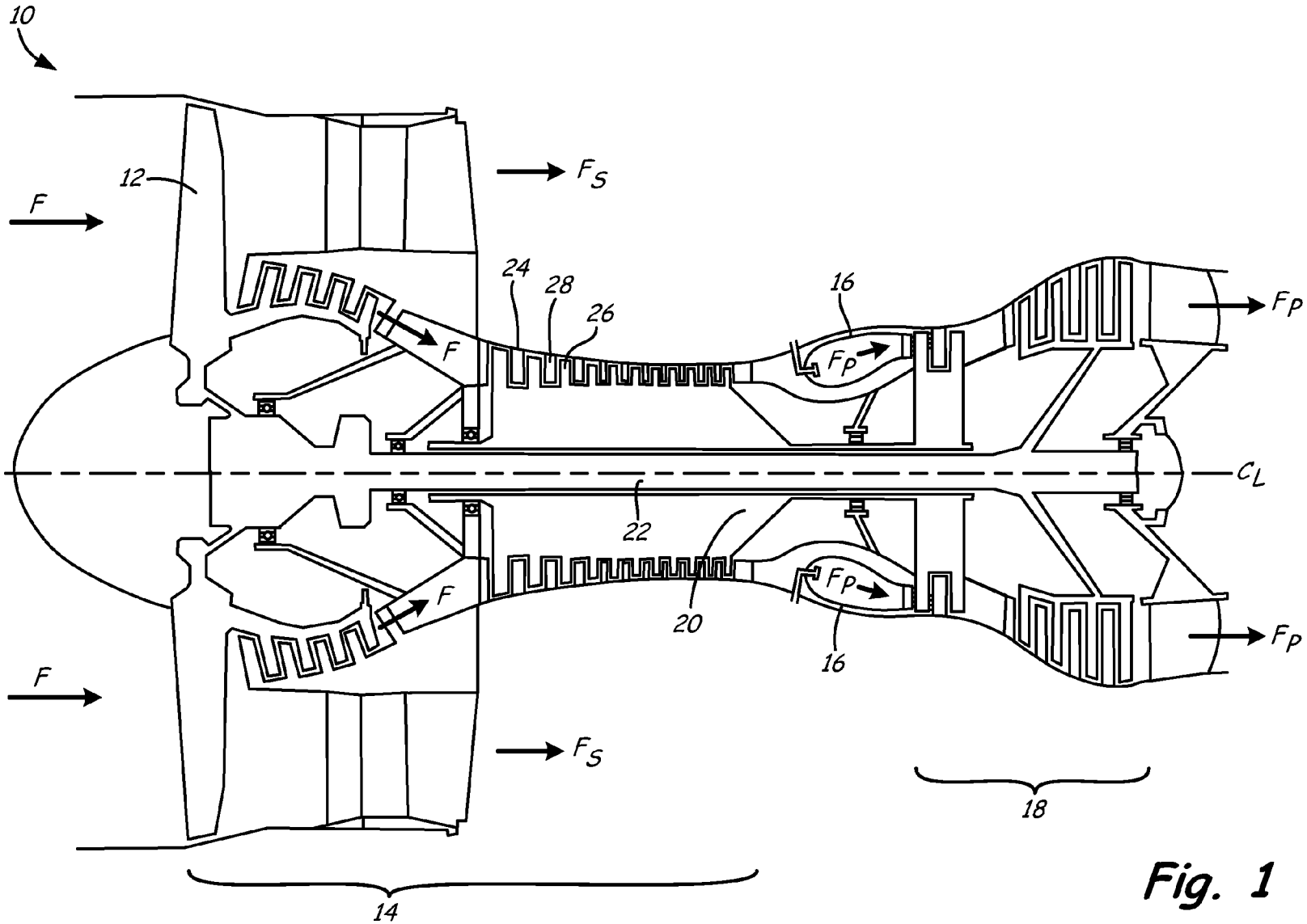
FIG. 1 is a cross-sectional view of a gas turbine engine according to an embodiment of the present invention.

FIG. 1 is a representative illustration of a gas turbine engine 10 including a synchronizing ring assembly of the present invention. The view in FIG. 1 is a longitudinal sectional view along an engine center line. FIG. 1 shows gas turbine engine 10 including a fan blade 12, a compressor 14, a combustor 16, a turbine 18, a high-pressure rotor 20, a low-pressure rotor 22, and an engine casing 24. Compressor 14 and turbine 18 include rotor stages 26 and stator stages 28.

As illustrated in FIG. 1, fan blade 12 extends from fan hub, which is positioned along engine center line $C_L$ near a forward end of gas turbine engine 10. Compressor 14 is disposed aft of fan blade 12 along engine center line $C_L$, followed by combustor 16. Turbine 18 is located adjacent combustor 16, opposite compressor 14. High-pressure rotor 20 and low-pressure rotor 22 are mounted for rotation about engine center line $C_L$. High-pressure rotor 20 connects a high-pressure section of turbine 18 to compressor 14. Low-pressure rotor 22 connects a low-pressure section of turbine 18 to fan blade 12 and a high-pressure section of compressor 14. Rotor stages 26 and stator stages 28 are arranged throughout compressor 14 and turbine 18 in alternating rows. Thus, rotor stages 26 connect to high-pressure rotor 20 and low-pressure rotor 22. Engine casing 24 surrounds turbine engine 10 providing structural support for compressor 14, combustor 16, and turbine 18, as well as containment for air flow through engine 10.

In operation, air flow F enters compressor 14 after passing between fan blades 12. Air flow F is compressed by the rotation of compressor 14 driven by high-pressure turbine 18. The compressed air from compressor 14 is divided, with a portion going to combustor 16, a portion bypasses through fan 12, and a portion employed for cooling components, buffering, and other purposes. Compressed air and fuel are mixed and ignited in combustor 16 to produce high-temperature, high-pressure combustion gases Fp. Combustion gases Fp exit combustor 16 into turbine section 18.

Stator stages 28 properly align the flow of air flow F and combustion gases Fp for an efficient attack angle on subsequent rotor stages 26. The flow of combustion gases Fp past rotor stages 26 drives rotation of both low-pressure rotor 20 and high-pressure rotor 22. High-pressure rotor 20 drives a high-pressure portion of compressor 14, as noted above, and low-pressure rotor 22 drives fan blades 12 to produce thrust Fs from gas turbine engine 10.

Although embodiments of the present invention are illustrated for a turbofan gas turbine engine for aviation use, it is understood that the present invention applies to other aviation gas turbine engines and to industrial gas turbine engines as well.

Figure 2:
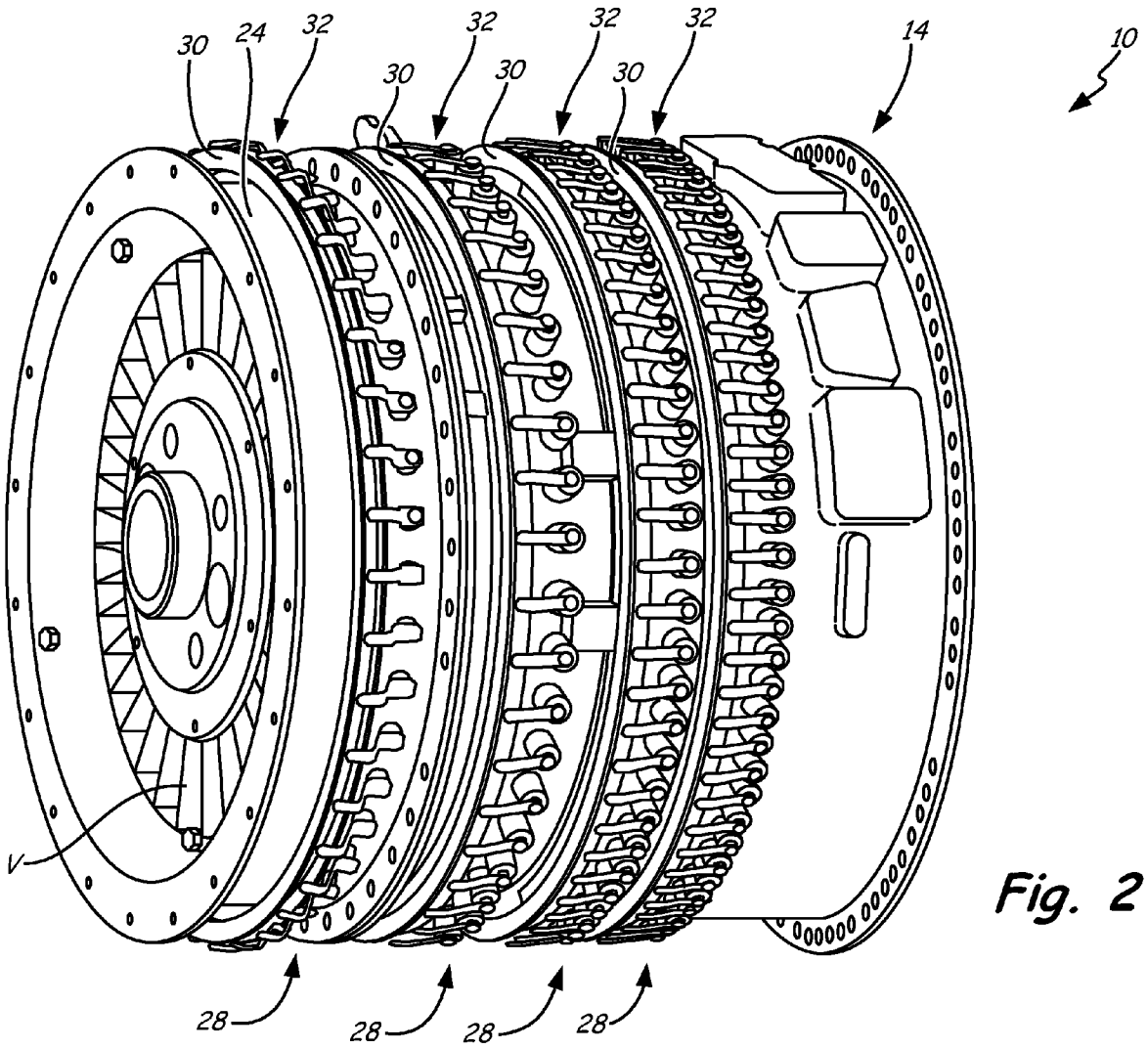
FIG. 2 is a perspective view of one embodiment of a gas turbine engine case with an assembly of synchronizing rings and vane arms.

FIG. 2 shows an exemplary portion of engine case 24 surrounding compressor 14. In addition to casing 24, FIG. 2 illustrates four stator stages 28. Each stator stage 28 includes a corresponding synchronizing ring 30 and vane arm assembly 32.

Although only one stage of variable vanes V is illustrated in FIG. 2, compressor 14 has multiple stages 28 of variable vanes. Each stage of variable vanes is connected to one synchronizing ring 30 via a plurality of vane arm assemblies 32. Synchronizing rings 30 are movably disposed about the exterior of casing 24.

Each vane arm assembly 32 is connected to a synchronizing ring 30 and is additionally connected to a variable vane V. More particularly, each vane arm assembly 32 is bolted or otherwise connected to a trunnion portion (FIG. 3) of each variable vane which protrudes from casing 24. As discussed previously, during operation synchronizing rings 30 are rotated relative to casing 24 by an actuator and linkage system (not shown) in order to vary the angular orientation of variable vanes V within gas turbine engine 10. Variable vanes V can be used in multiple locations including the high pressure compressor (HPC) as well as the low pressure compressor (LPC) sections of gas turbine engine 10.

Figure 3:
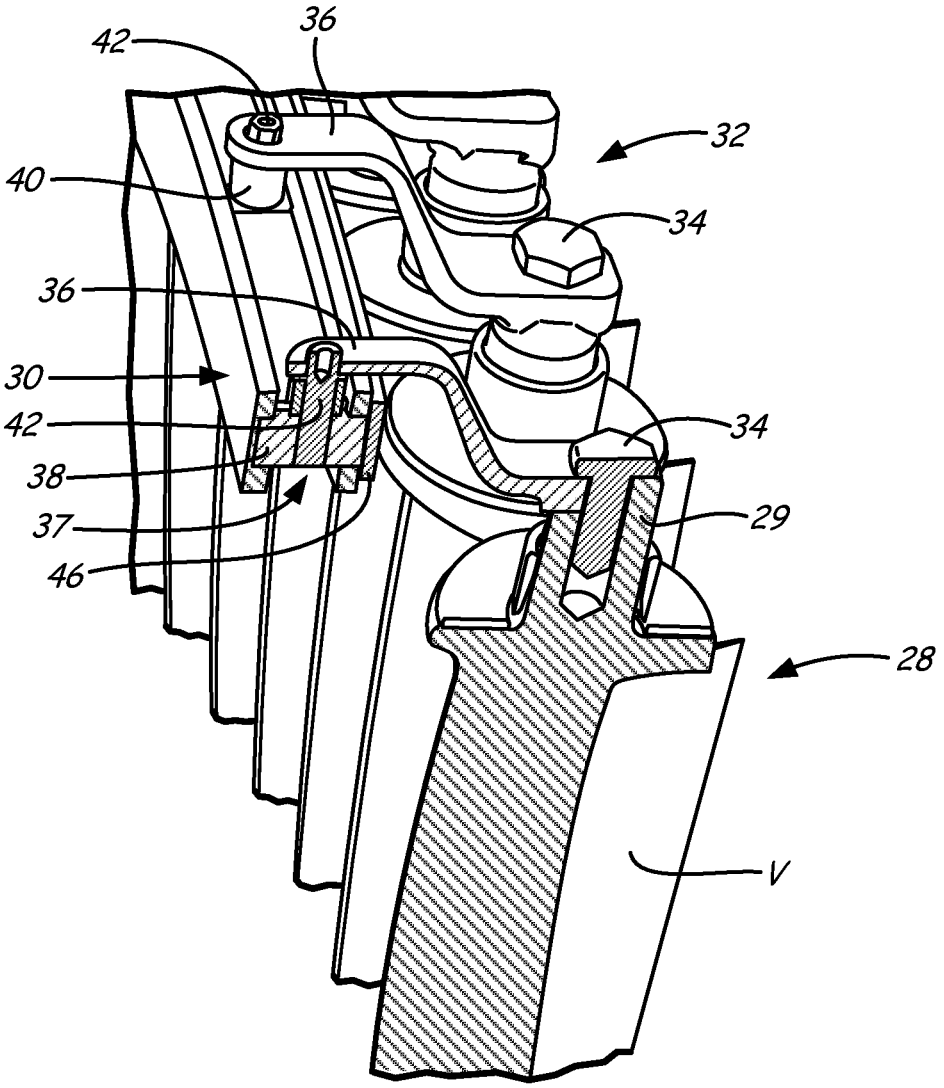
FIG. 3 is a perspective view with a cross-section of one embodiment of a synchronizing ring, vane arm, and a variable vane.

FIG. 3 shows one stator stage 28 of variable vanes V with casing 24 (FIGS. 1 and 2) removed. Each variable vane V includes a vane trunnion 29. In addition to synchronizing ring 30, each vane arm assembly 32 includes a fastener 34, a vane arm main body 36, a multiaxis joint feature 37 and a bushing 40. The multi-axis joint feature 37 includes a first trunnion 38 and a second trunnion 42. Synchronizing ring 30 includes a main body 44 and a cover plate 46.

Each vane arm assembly 32 connects synchronizing ring 30 to each variable vane V. At a first end of vane arm assembly 32, fastener 34 connects vane arm main body 36 to an outer radial portion of vane trunnion 29. At a second end of vane arm assembly 32, vane arm main body 36 is pivotally connected to synchronizing ring 30. In particular, first trunnion 38 is disposed within synchronizing ring 30 and comprises a rotatable feature about which vane arm 5 main body 36 can pivot relative to synchronizing ring 30. Bushing 40 is disposed adjacent first trunnion 38 and is disposed around second trunnion 42. Bushing 40 extends between first trunnion 38 and vane arm main body 36. Second trunnion 42 comprises a rotatable pin about which vane arm main body 36 can pivot relative to synchronizing ring 30. Thus, first trunnion 38 and second trunnion 42 allow vane arm main body 36 to pivot about two intersecting rotational axes relative to the synchronizing ring 30.

As shown in FIG. 3, second trunnion 42 comprises a pin that is received in a central portion of first trunnion 38. Second trunnion 42 extends from first trunnion 38 and main body 44 to connect to vane arm main body 36. Cover plate 46 is disposed on an aft surface of synchronizing ring 30. Cover plate 46 encloses and holds first trunnion 38 within the remainder of synchronizing ring 30.

Multi-axis joint 37 serves as a component that connects vane arm main body 36 to synchronizing ring 30. During operation when synchronizing ring 30 moves circumferentially about a rotational axis relative to casing 24 (FIGS. 1 and 2), the movement of synchronizing ring 30 circumferentially translates and rotates vane arm main body 36 pivotally around second trunnion 42. Additionally, first trunnion 38 pivots and self aligns with second trunnion 42, which results in binding free movement of vane arm main body 36. This [[is]] binding free movement is achieved because first trunnion 38 creates an additional degree of freedom in the assembly, thus reducing or eliminating the mechanical constraints induced by the positioning change of the synchronizing ring 30 relative to the variable vane V. Thus, first trunnion 38 allows second trunnion 42 to pivot freely without inducing preload or moment to vane arm main body 36.

Figure 4A:
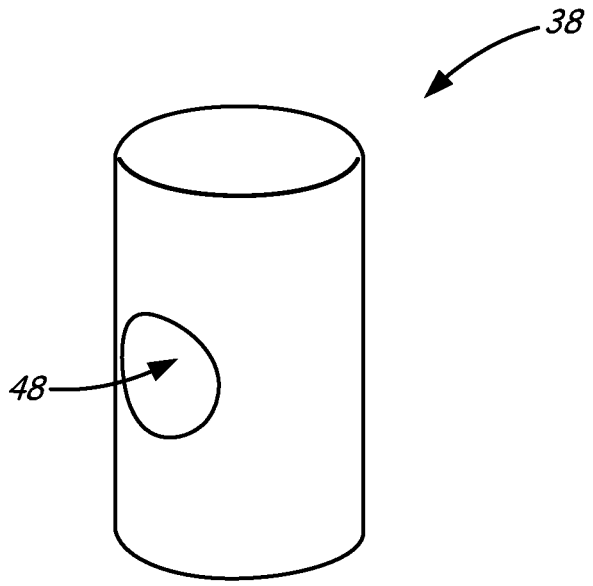
FIG. 4A is a perspective view of a first trunnion.
Figure 4B:
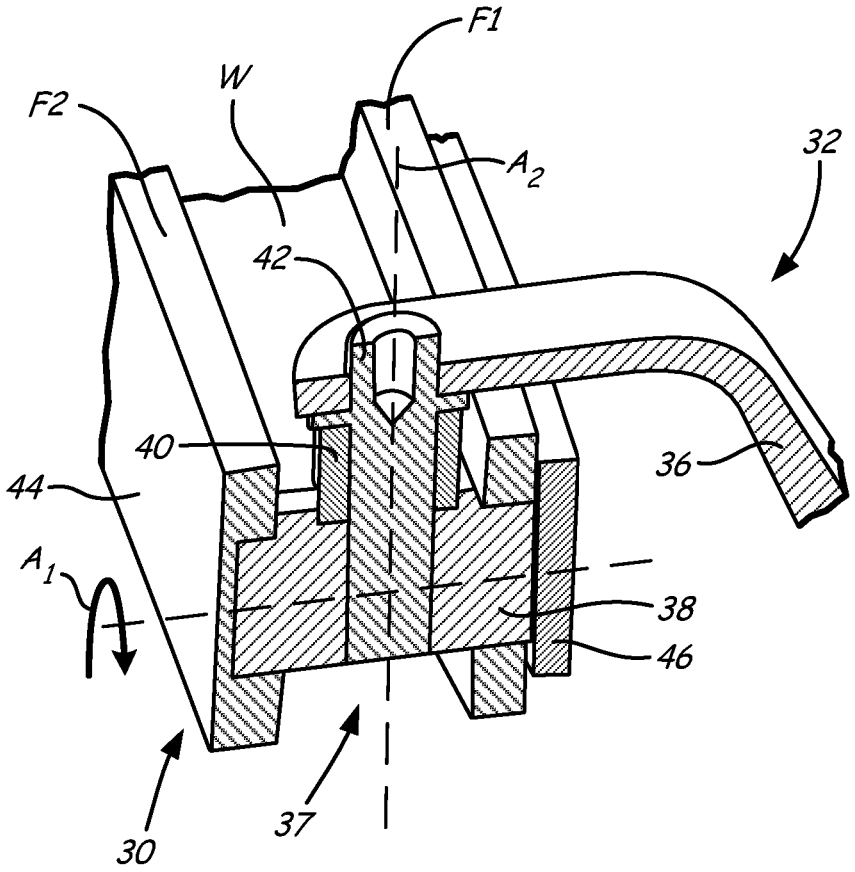
FIG. 4B is perspective view with a cross-section of the synchronizing ring, variable vane, vane arm, and the first trunnion of FIG. 4A.

FIGS. 4A and 4B show first trunnion 38. In particular, FIG. 4A shows first trunnion 38 includes a central hole 48 therein. FIG. 4B shows a cross-sectional view of synchronizing ring 30 and vane arm assembly 32. As previously discussed, vane arm assembly 32 includes fastener 34, vane arm main body 36, bushing 40, and second trunnion 42. Synchronizing ring 30 includes main body 44 and cover plate 46. In the illustrated embodiment the main body 44 includes first flange F1, second flange F2 and web W.

As shown in FIGS. 4A and 4B, central hole 48 that extends through a central circumferential surface of first trunnion 38. The central hole 48 receives second trunnion 42 therein. As shown in FIG. 4B, second trunnion 42 extends from first trunnion 38 and synchronizing ring 30 to connect to, and provide a trunnion pin for, vane arm main body 36.

FIG. 4B illustrates the rotational axis $A_1$ of first trunnion 38. The rotational axis $A_2$ of second trunnion 42 intersects with the rotational axis $A_1$ of first trunnion 38. Because synchronizing ring 30 is movable about a rotational axis relative to casing 24 (FIGS. 1 and 2), the first trunnion 38 pivots about rotational axis $A_1$, and the second trunnion 42 pivots about rotational axis $A_2$, the assembly has multiple degrees of freedom allowing for binding free movement of vane arm main body 36.

Figure 5A:
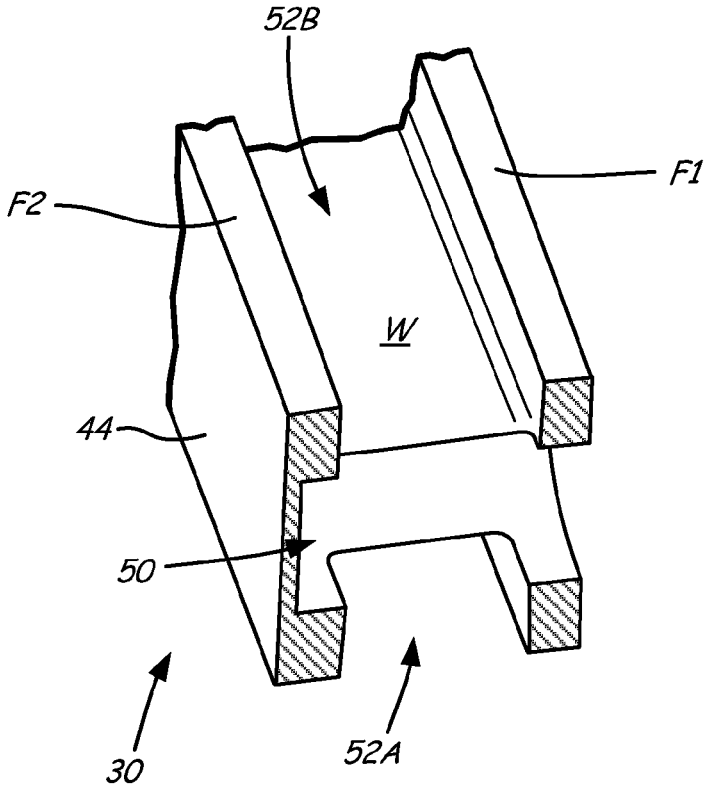
FIG. 5A is a perspective view of one embodiment of the synchronizing ring.
Figure 5B:
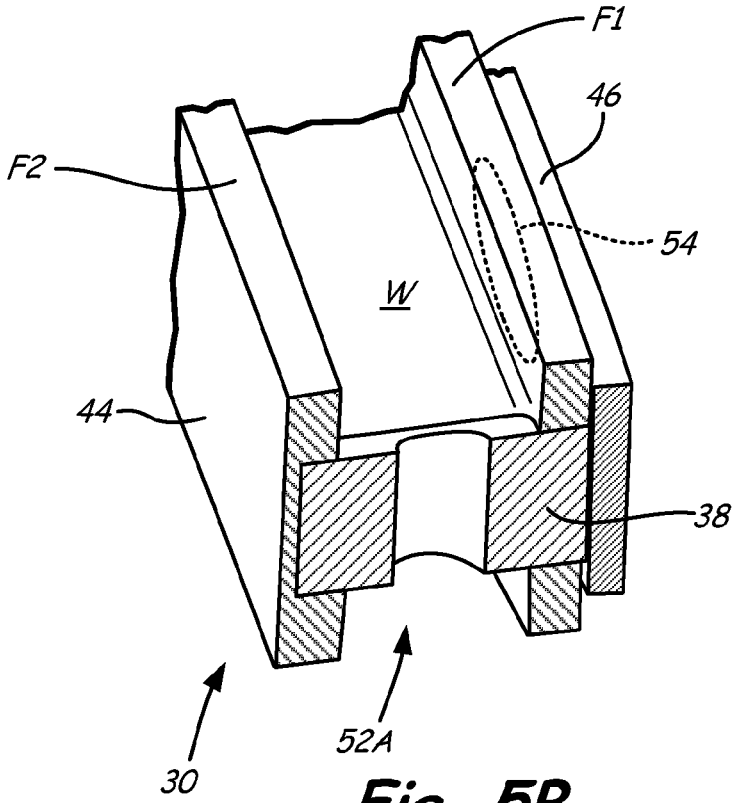
FIG. 5B is a perspective view of the synchronizing ring of FIG. 5A with a cover plate and the first trunnion installed.

FIGS. 5A and 5B show the embodiment of synchronizing ring 30 from FIGS. 3 and 4B. FIG. 5A shows synchronizing ring 30 with cover plate 46 removed. Synchronizing ring 30 includes main body 44, a cavity 50, and channels 52A and 52B. FIG. 5B illustrates synchronizing ring 30 with cover plate 46 and first trunnion 38 installed.

In the embodiment of synchronizing ring 30 shown in FIGS. 5A and 5B, synchronizing ring 30 has an I-beam cross-sectional shape with channels 52A and 52B in opposing surfaces of main body 44. In other embodiments, synchronizing ring 30 can have any cross-sectional shape including a square, round, or rectangular shape. Cavity 50 extends through the central portion of main body 44 and is open to channels 52A and 52B on either side. Cavity 50 is a counter-bore feature open at one end and is adapted to receive first trunnion 38 therein. Thus, when installed portions of first trunnion 38 interface with channels 52A and 52B. As shown in FIG. 5B, cover plate 46 can be connected to main body 44 by fasteners 54. Cover plate 46 holds first trunnion 38 within synchronizing ring 30.

Figure 6:
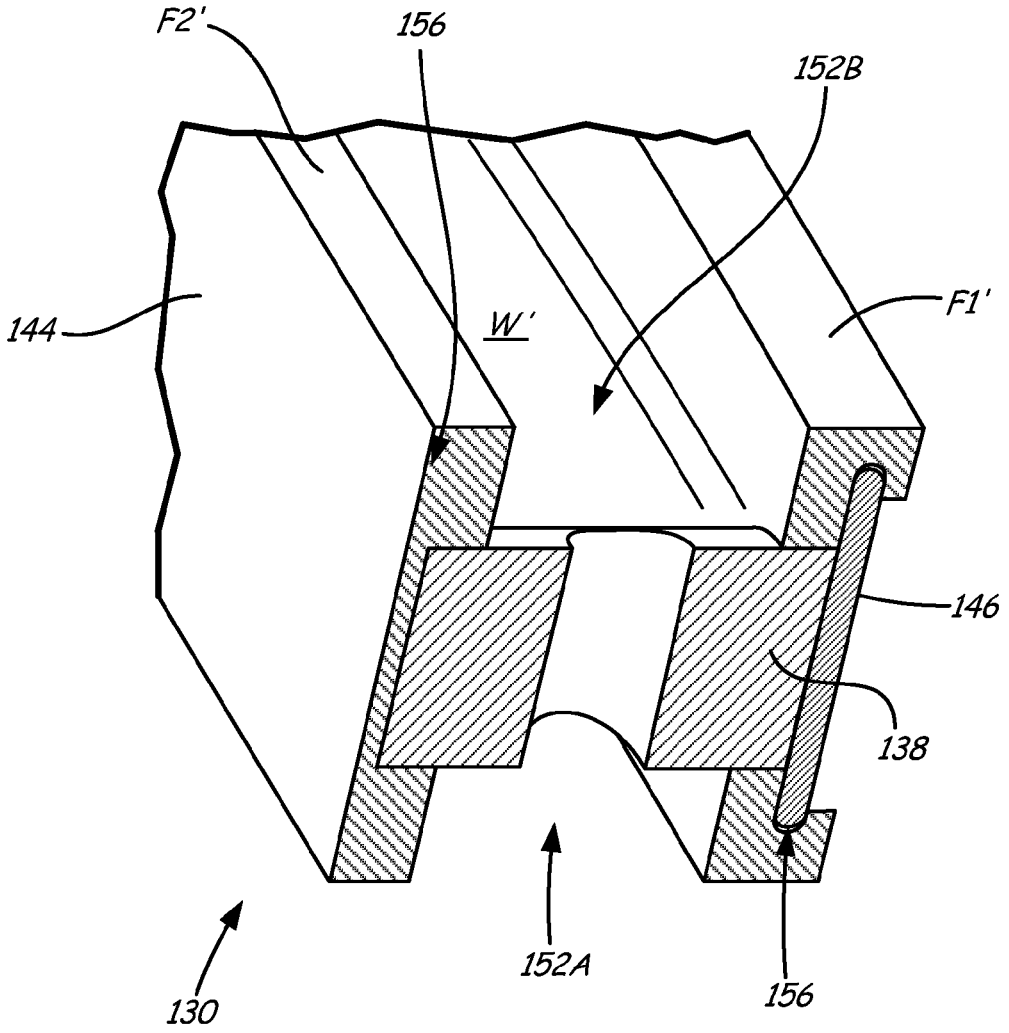
FIG. 6 is a perspective view of a second embodiment of a synchronizing ring including a cover plate and first trunnion.

FIG. 6 shows a second embodiment of synchronizing ring 130 which is similar to synchronizing ring 30 (FIGS. 2, 3, and 4B) but includes a different connection to hold a cover plate 146 to synchronizing ring 130. As illustrated in FIG. 6, synchronizing ring 130 includes a main body 144, cover plate 146, channels 152A and 152B, and grooves 156. In the illustrated embodiment the main body 144 includes first flange F1', second flange F2' and web W'. FIG. 5B additionally illustrates an embodiment of first trunnion 138 installed in synchronizing ring 130.

Similar to the embodiment of synchronizing ring 30 shown in FIGS. 5A and 5B, synchronizing ring 130 of FIG. 6 has an I-beam cross-sectional shape with channels 152A and 152B in opposing surfaces of main body 144. When installed, portions of first trunnion 138 interface with channels 152A and 152B. As shown in FIG. 6, cover plate 146 is retained to main body 144 by grooves 156. Grooves 156 allow cover plate 146 to be installed in and retained in main body 144. Cover plate 146 holds first trunnion 138 within synchronizing ring 130A.

The present application discloses a joint feature that allows a vane arm to be actuated by synchronizing ring with reduced bending/twisting moment on the vane arm. In particular, the joint feature introduces an additional degree of freedom into the system by allowing the vane arm to pivot about a second rotational axis relative to the synchronizing ring. As a result of introducing the joint feature, the size and weight of an actuator required to move the synchronizing ring can be reduced. Additionally, introducing the first trunnion improves positioning accuracy of the variable vanes, which has a positive impact to engine performance.

Discussion of Possible Embodiments

The following are non-exclusive descriptions of possible embodiments of the present invention.

An assembly includes a synchronizing ring, a vane arm, and a multi-axis joint. The multi-axis joint connects the synchronizing ring to the vane arm and provides the vane arm with movement about a first pivot axis and a second pivot axis.

The assembly of the preceding paragraph can optionally include, additionally and/or alternatively, any one or more of the following features, configurations and/or additional components:

the multi-axis joint has a first trunnion that is held within the synchronizing ring by a cover plate;

the cover plate is retained to the synchronizing ring by at least one of a fastener and/or grooves;

the synchronizing ring has an I-beam cross-sectional shape;

the multi-axis pivot joint has a first trunnion and a second trunnion, and wherein the synchronizing ring is movable about an axis, the first trunnion rotates about the first pivot axis, and the second trunnion rotates about the second pivot axis;

the multi-axis joint has a second trunnion that comprises a pin, and wherein the first trunnion has a hole that receives the pin therein;

wherein the multi-axis joint has a first trunnion that defines the first pivot axis and a second trunnion that defines the second pivot axis, and wherein the first pivot axis intersects with the second pivot axis; and the first pivot axis is perpendicular to the second pivot axis.

A kit includes a synchronizing ring, a vane arm and a multi-axis joint. The multi-axis joint adapted to be disposed in and extend from the synchronizing ring to connect the vane arm to the synchronizing ring.

The kit of the preceding paragraph can optionally include, additionally and/or alternatively, any one or more of the following features, configurations and/or additional components:

the kit includes a cover plate adapted to hold the multi-axis joint within the synchronizing ring;

the cover plate is retained to the synchronizing ring by at least one of a fastener and/or grooves;

the synchronizing ring has an I-beam cross-sectional shape; and wherein the multi-axis joint provides the vane arm with movement about a first pivot axis and a second pivot axis, and wherein the multi-axis joint has a first trunnion and a second trunnion.

A gas turbine engine includes an engine case, a compressor and/or turbine section, a synchronizing ring, a plurality of vane arms and a plurality of multi-axis joints. The compressor and/or turbine section has at least a first stage of variable vanes circumferentially spaced radially inward of the engine case. The synchronizing ring is disposed about the engine case. The vane arms are connected to the variable vanes. The plurality of multi-axis joints connect the synchronizing ring to the vane arms and each multi-axis joint provides each vane arm with movement about a first pivot axis and a second pivot axis.

The gas turbine engine of the preceding paragraph can optionally include, additionally and/or alternatively, any one or more of the following features, configurations and/or additional components:

the multi-axis joint has a first trunnion that is held within the synchronizing ring by a cover plate;

the cover plate is retained to the synchronizing ring by at least one of a fastener and/or grooves;

the synchronizing ring has an I-beam cross-sectional shape;

the multi-axis pivot joint has a first trunnion and a second trunnion, and wherein the synchronizing ring is movable about an axis, the first trunnion rotates about the first pivot axis, and the second trunnion rotates about the second pivot axis;

the multi-axis joint has a second trunnion that comprises a pin, and wherein the first trunnion has a hole that receives the pin therein;

the multi-axis joint has a first trunnion that defines the first pivot axis and a second trunnion that defines the second pivot axis, and wherein the first pivot axis intersects with the second pivot axis;

the multi-axis joint has a first trunnion that defines the first pivot axis and a second trunnion that defines the second pivot axis, and wherein the first pivot axis intersects with the second pivot axis; and the first pivot axis is perpendicular to the second pivot axis.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A gas turbine engine comprising:

an engine case;

a compressor and/or turbine section having at least a first stage of variable vanes circumferentially spaced radially inward of the engine case;

a synchronizing ring disposed about the engine case wherein the synchronizing ring has an I-beam cross-sectional shape with channels in opposing surfaces of the synchronizing ring wherein one channel is on a surface facing radially inward;

a plurality of vane arms connected to the variable vanes; and a plurality of multi-axis joints connecting the synchronizing ring to the vane arms, each multi-axis joint providing each vane arm with movement about a first pivot axis and a second pivot axis, wherein the plurality of multi-axis joints interface with the channels in the synchronizing ring, wherein the multi-axis joints each have a first trunnion that is held within the synchronizing ring by a cover plate.

2. The gas turbine engine of claim 1, wherein the cover plate is retained to the synchronizing ring by at least one of a fastener and grooves.

3. The gas turbine engine of claim 1, wherein each multi-axis joint includes a first trunnion and a second trunnion, and wherein the synchronizing ring is movable about an axis, the first trunnion rotates about the first pivot axis, and the second trunnion rotates about the second pivot axis.

4. The gas turbine engine of claim 1, wherein each multi-axis joint includes a second trunnion that comprises a pin, and wherein a first trunnion has a hole that receives the pin therein.

5. The gas turbine engine of claim 1, wherein each multi-axis joint has a first trunnion that defines the first pivot axis and a second trunnion that defines the second pivot axis, and wherein the first pivot axis intersects with the second pivot axis.

6. The gas turbine engine of claim 1, wherein the first pivot axis is perpendicular to the second pivot axis.

7. An assembly comprising:

a synchronizing ring wherein the synchronizing ring has an I-beam cross-sectional shape with channels in opposing surfaces of the synchronizing ring wherein one channel is on a surface facing radially inward;

a vane arm; and a multi-axis joint connecting the synchronizing ring to the vane arm, the multi-axis joint providing the vane arm with movement about a first pivot axis and a second pivot axis, wherein the multi-axis joint has a first trunnion that is held within the synchronizing ring by a cover plate.

8. The assembly of claim 7, wherein the cover plate is retained to the synchronizing ring by grooves.

9. The assembly of claim 8, wherein the synchronizing ring has a first flange, a second flange, and a web connecting the first flange and the second flange, wherein the first flange is opposite the second flange and the first flange contains the grooves.

10. The assembly of claim 7, wherein the multi-axis joint has a first trunnion and a second trunnion, and wherein the synchronizing ring is movable about an axis, the first trunnion rotates about the first pivot axis, and the second trunnion rotates about the second pivot axis.

11. The assembly of claim 7, wherein the multi-axis joint has a second trunnion that comprises a pin, and wherein a first trunnion has a hole that receives the pin therein.

12. The assembly of claim 7, wherein the multi-axis joint has a first trunnion that defines the first pivot axis and a second trunnion that defines the second pivot axis, and wherein the first pivot axis intersects with the second pivot axis.

13. The assembly of claim 12, wherein the first pivot axis is perpendicular to the second pivot axis.

14. An assembly comprising:

a synchronizing ring wherein the synchronizing ring has an I-beam cross-sectional shape with channels in opposing surfaces of the synchronizing ring wherein one channel is on a surface facing radially inward;

a vane arm; and a multi-axis joint connecting the synchronizing ring to the vane arm, the multi-axis joint providing the vane arm with movement about a first pivot axis and a second pivot axis, wherein a first trunnion interrupts a web extending between a first flange and a second flange of the I-beam shaped synchronizing ring.

15. A kit comprising:

a synchronizing ring wherein the synchronizing ring has an I-beam cross-sectional shape with channels in opposing surfaces of the synchronizing ring wherein one channel is on a surface facing radially inward;

a vane arm;

a multi-axis joint adapted to be disposed in and extend from the synchronizing ring to connect the vane arm to the synchronizing ring; and a cover plate adapted to hold the multi-axis joint within the synchronizing ring.

16. The kit of claim 15, wherein the cover plate is retained to the synchronizing ring by at least one of a fastener and grooves.

17. The kit of claim 15, wherein the multi-axis joint provides the vane arm with movement about a first pivot axis and a second pivot axis, and wherein the multi-axis joint has a first trunnion and a second trunnion.

* * * * *